US006219081B1

(12) United States Patent
Sasaki et al.

(10) Patent No.: US 6,219,081 B1
(45) Date of Patent: Apr. 17, 2001

(54) IMAGE FORMING APPARATUS

(75) Inventors: Yoshiharu Sasaki; Mitsuru Sawano, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/540,885

(22) Filed: Mar. 31, 2000

(30) Foreign Application Priority Data

Mar. 31, 1999 (JP) ..... 11-093437

(51) Int. Cl.[7] ..... B41M 5/26; B41J 2/32; B41J 2/325

(52) U.S. Cl. ..... 347/213; 347/224; 347/171

(58) Field of Search ..... 347/171, 213, 347/172, 224; 346/134, 138

(56) References Cited

U.S. PATENT DOCUMENTS 4,931,334 * 6/1990 Shiozawa et al. ..... 428/137
5,663,755 * 9/1997 Wada et al. ..... 347/213

FOREIGN PATENT DOCUMENTS 7-290731 11/1995 (JP) ..... B41J/2/32

* cited by examiner

*Primary Examiner*—Huan Tran
(74) *Attorney, Agent, or Firm*—Sughrue, Mion, Zinn, Macpeak & Seas, PLLC

(57) ABSTRACT

Disclosed is an image forming apparatus comprising a first drum having an image receiving portion, an exposure section for applying imagewise thermal energy to the second drum in a state that a toner sheet with an image forming thin film is superposed on the image receiving portion of the first drum, with the image forming thin film being layered on the image receiving portion of the first drum, and a second drum for holding a final image supporting sheet thereon for finally supporting an image thereon.

In the image forming apparatus, after an image is formed through the likewise application of the thermal energy by the exposure section and the image is transferred onto the image receiving portion, the toner sheet is separated from the image receiving portion of the first drum, and the final image supporting sheet is pressed against a predetermined location on the image receiving portion by a relative movement of the first drum to and from the second drum.

8 Claims, 6 Drawing Sheets

FIG. 2( f )

IMAGE FORMING APPARATUS

BACKGROUND OF THE INVENTION

1. Field of the Invention

The present invention relates to an image forming apparatus, and more particularly to an image forming apparatus of the type in which thermal energy is imagewise patterned applied to a toner sheet with a thin film, and after several steps of peeling-off and development, an imagewise patterned thin film is finally transferred onto an image supporting member.

2. Description of the Background Art

An image forming apparatus is known in which thermal energy is imagewise applied to a toner sheet with a thin film thereon, an imagewise patterned thin film is transferred from the toner sheet onto an image receiving sheet by the step of peeling-off/development, and the imagewise patterned thin film is transferred again from the image receiving sheet onto a permanent image supporting member (JP-A-7-290731).

FIG. 5 is a schematic diagram showing this image forming apparatus. The image forming apparatus includes a photosensitive member supplying section 132, an image forming drum 134, a photosensitive member fixing/releasing mechanism 136 located on the image forming drum 134, a laminate mechanism 138 disposed along the outer circumference of the image forming drum 134, an exposure head 140, a peeling-off mechanism 142, a paper supplying section 144, a laminate section 146, a fixing section 148, a peeling-off section 150, a tray section 152, and a control unit.

An image receiving member 12 and a toner sheet 10 of a first color (for example, C (cyan))are supplied from the photosensitive member supplying section 132 to the image forming drum 134.

The image receiving member 12 is fixed onto the drum 134 by means of the photosensitive member fixing/releasing mechanism 136.

Then, the toner sheet is pressed against the image forming drum by means of the laminate mechanism 138, so that the toner sheet 10 is laminated on the image receiving member 12. Then, a laser exposure of the laminated sheet is carried out in a heat mode by use of the exposure head 140, which is controlled in accordance with an image signal by the control unit. As a result, an image is recorded on the toner sheet as a latent image.

Thereafter, the toner sheet 10 is peeled off from the image receiving member 12 fixed onto the image forming drum 134, by means of the a peeling-off mechanism 142, and only the coloring material of the image formed as the latent image is transferred to the image receiving member 12, and developed. Subsequently, the coloring materials of images of second to fourth colors (for example, Y (yellow), M (magenta), C(cyan) and K (black)), which are to be formed as latent images, are transferred to the image receiving member 12 and developed in similar ways.

The image receiving member 12 having the images of all the colors formed thereon is peeled off from the drum 134, and transported to the laminate section 146. In the laminate section 146, a paper sheet (final image supporting member) 14 that is supplied from the paper supplying section 144 is registered with and superposed on the image receiving member 12 by a register roller pair 75. Then, the resultant is transported to the fixing section 148. In the fixing section 148, it is nipped and transmitted with a heating/fixing roller pair 76, whereby the image is heated and fixed. Thereafter, in the peeling-off section 150, the imagewise patterned coloring material is transferred from the image receiving member 12 onto the paper sheet 14, and the paper sheet 14 bearing the image transferred thereon is discharged as a hard copy into the tray section 152.

In the conventional apparatus described in the prior art discussion as above, the lamination of the image receiving member laminated on and the paper sheet is nipped with the heating/fixing roller pair 76 of the fixing section 148, and simultaneously compressed and heated. However, it is necessary to position the image receiving member 12 relative to the paper sheet 14 or put those to be in register before the heating/fixing process. Such simultaneous positioning of two things, viz., the image receiving member 12 and the paper sheet 14, requires fine adjustments for the transporting speeds of them, for example, and leads to increase of the possibility of causing the jam and displacements (or out-of-register of them). A possible reliable solution to the problem of the jam and the out-of-register is to take the following procedure. That is, following the transferring of the latent image to the image receiving member 12 and the developing of it, the image receiving member 12 is stripped off from the drum, and taken out of the apparatus by manual. Then it is manually superposed on the paper sheet 14 as the final image supporting member, and the image is transferred again to the paper sheet. In the process of the re-transferring process including the taking the image receiving member out of the apparatus by manual, dust inevitably sticks to those members. The sticking of dust forms a cause to deteriorate the quality of the resultant image.

Accordingly, an object of the present invention is to provide an image forming apparatus in which an overall image forming process is automated while securing a stable transporting capability, and carried out in a through-process manner, prevents the dust sticking, and well performs the re-transferring of the image onto the paper sheet.

SUMMARY OF THE INVENTION

To achieve the above object, there is provided an image forming apparatus comprising: a first drum having an image receiving portion on which a toner sheet with an image forming thin film is superimposed in a state that the image forming thin film of the toner sheet is layered on the image receiving portion of the first drum; an exposure section for applying imagewise thermal energy toward the first drum through the toner sheet side; and a second drum for holding a final image supporting sheet thereon for finally supporting an image thereon; wherein after an image is formed through the likewise application of the thermal energy by the exposure section, the toner sheet is separated from the image receiving portion of the first drum, an image is transferred onto the image receiving portion, and the final image supporting sheet is pressed against a predetermined location on the image receiving portion by a relative movement of the first drum to and from the second drum.

In the image forming apparatus thus constructed, the image receiving portion includes an image receiving sheet and an image receiving layer layered on the image receiving sheet.

Further, the image receiving sheet is supplied from a sheet supplying portion located within the fist drum, through an axially oriented opening formed in the surface of the first drum, to the surface of the first drum, and is taken up by a take-up portion located within the first drum.

In the invention, after the image is formed and the image is transferred to the image receiving portion, the image receiving portion is not peeled off the first drum. The final image supporting sheet is pressed against a predetermined location on the image receiving portion by use of the second drum. Therefore, the superposing of the two sheets is reliable and easy. Accordingly, an overall image forming process is automated wile securing a stable transporting capability, and hence carried out in a through-process manner. Therefore, the dust sticking is prevented, and the re-transferring of the image onto the paper sheet is well performed.

BRIEF DESCRIPTION OF THE DRAWINGS

Other objects, advantages and features of the invention will be apparent when carefully reading the detailed description in connection with the drawings.

DETAILED DESCRIPTION OF THE PREFERRED EMBODIMENTS

Image forming apparatuses which are the preferred embodiments of the present invention will be described with reference to the accompanying drawings.

Figure 1:
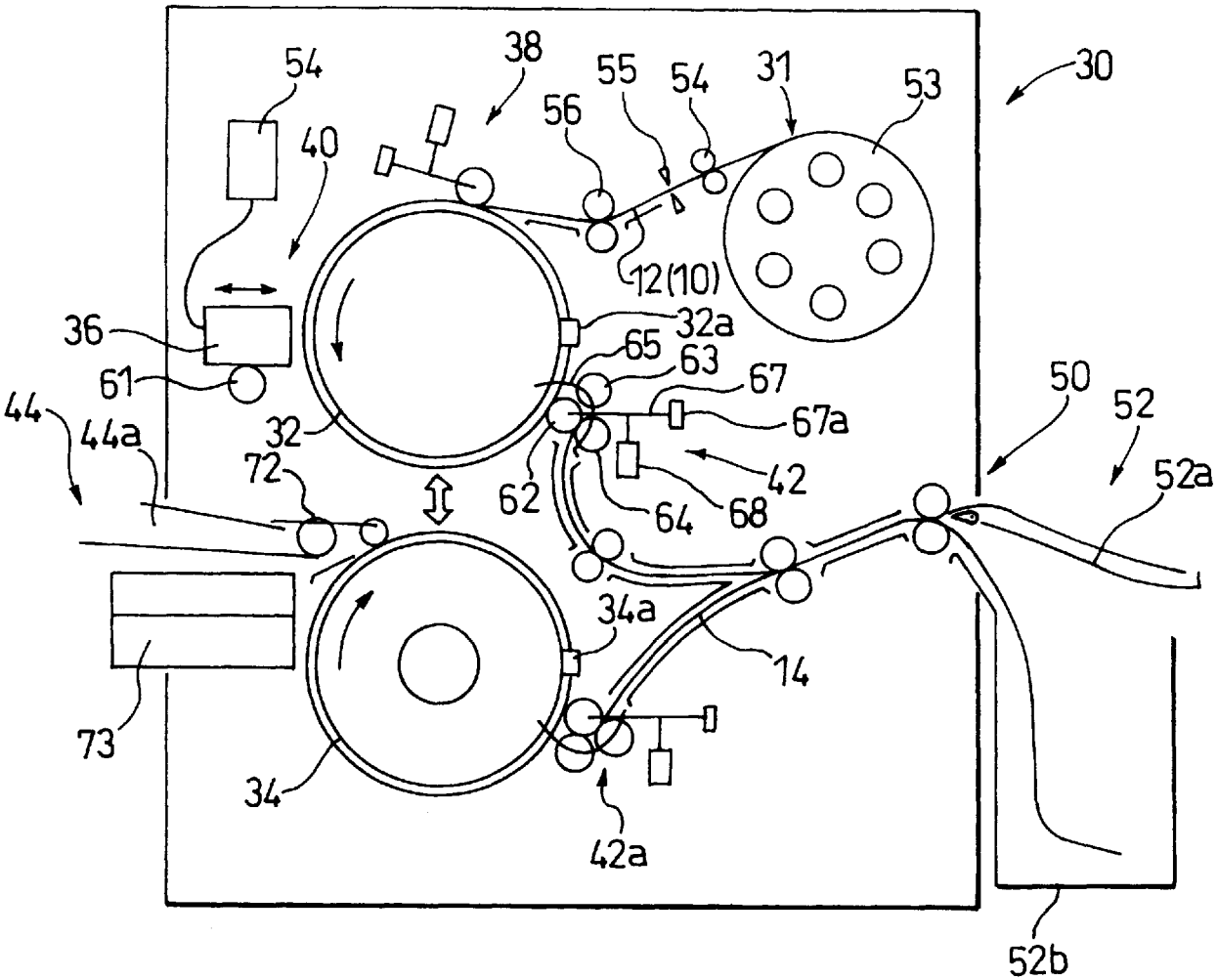
FIG. 1 is a side view showing an image forming apparatus which an embodiment of the present invention.

FIG. 1 is a cross sectional view showing a model of an image forming apparatus which an embodiment of the present invention. FIG. 1 is a set of cross sectional views showing a color image forming process which is applied to the image forming apparatus shown in FIG. 1. It should be understood that the image forming process shown in FIG. 2 is given by way of example, and hence it may take any of other variety of processes. Before proceeding with description of the image forming apparatus shown in FIG. 1, the color image forming process shown in FIG. 2 will briefly be describe. A toner sheet and an image receiving layer (image receiving sheet), which are described in detail in the specification of Japanese Patent Application No. 5-275749, filed by the applicant of the present patent application, are available for those used in the color image forming apparatus of the present embodiment.

Structures of the respective sheets shown in FIG. 2 will be described.

A toner sheet 10 is formed with a support member 18, an photo thermal conversion layer 19, formed on the support member 18 and containing optical-to-thermal material, a support member 18, a heat peeling-off layer 20 formed on the photo thermal conversion layer 19, and a toner layer 22 formed on the heat peeling-off layer 20.

The support member 18 of the toner sheet 10 has a function to mechanically supporting the photo thermal conversion layer 19, the heat peeling-off layer 20 and the toner layer 22. For this reason, a material of the support member 18 is preferably high in mechanical strength and heat resistance and exhibits high resistance for organic solvent.

In a case that the exposing light is radiated on the support member 18 9*f* the toner sheet structure, it is essential that a transmittance of the support member 18 to an radiation light wave length is high. Where a laser is used for a light source and it is reduced in diameter into a small spot of 10 $\mu$m (diameter), it is desirable that a refractive index of the support member 18 is small.

The photo thermal conversion layer 19 has a function to absorb a laser beam used as a heating/recording means or high density energy light emitted from a light source, such as a xenon flash lamp, and to transform it into thermal energy. When a laser device is used for the heating/recording means is preferably a semiconductor laser, for example, a laser diode (LD). Light absorbing material, such as organic coloring material, is contained in the photo thermal conversion layer 19. Where a thermal head is used for the heating/recording means, the toner sheet not including the photo thermal conversion layer 19 may be used.

In the image recording process according to the invention, the photo thermal conversion layer 19 is heated to an extremely high temperature at time of high density energy irradiation. When the photo thermal conversion layer 19 changes its properties or is molten due to the extreme temperature rise, part of the photo thermal conversion layer 19 is transferred to an image receiving sheet 12 in a peeling-off process, thereby possibly causing a color mixing. For this reason, it is required that the photo thermal conversion layer 19 used in an image recording method of the invention less changes its properties by heat than the heat peeling-off layer 20, which will be described later.

In a state of no high density energy light radiation or no heating, the heat stripping-off layer 20 intervenes between the photo thermal conversion layer 19 or the support member 18 an the toner layer 22 to join them together. The heat stripping-off layer 20 also prevents such an undesired situation that in the process of the stripping-off/development, part of the high density energy light irradiation region of the photo conductive conversion layer 19 is transferred to the image receiving sheet 12, thereby causing a color mixing. It further improves a recording sensitivity. In other words, the heat stripping-off layer 20 receives heat that is absorbed by the photo conductive conversion layer 19 or heat from the support member 18 to reduce a bonding force between the photo conductive conversion layer 19 or the support member 18 and the heat stripping-off layer 20 or a cohesive force.

The toner layer 22 contains organic pigments of yellow (M), magenta (M), cyan (C) and black (K). A protecting film may be stuck over the surface of the toner layer 22, if necessary.

The toner sheet 10 consists of the respective layers described above, which are layered on the support member 18. In a normal state, the heat stripping-off layer 20 and the toner layer 22 are strongly bonded together. When it is heated directly by the heating/recording means, such as a thermal head or a laser, or indirectly through an photo conductive conversion operation by the photo conductive conversion layer 19, a thermal reaction, e.g., thermal decomposition reaction, takes place in a heated portion of the heat stripping-off layer 20. The result is to greatly reduce the bonding force between the photo conductive conversion layer 19 or the support member 18 and the toner layer 22. Accordingly, only the heated portion of the heat stripping-off layer 20 is changed in its property to be easy to be stripped off.

The image receiving sheet 12 has a structure including a supporting member 26, a cushion layer 28 formed on the supporting member 26, and an image receiving layer 16 formed on the cushion layer 28. Image receiving sheets having other structures than the structure mentioned above may be used for the image receiving sheet 12 of the invention. Some examples of those structures (not shown) are: a structure in which the image receiving layer 16 serves also as the cushion layer, another structure not including the cushion layer 28, and an additional structure in which the supporting member 26 serves also as the image receiving layer 16.

The cushion layer 28 is elastic, and absorbs a pressing force which acts between the toner sheet 10 and the image receiving sheet 12 in the transferring process. Further, it closely joins the toner layer 22 of the toner sheet 10 to the supporting member 26 of the image receiving sheet 12. It also allows foreign particles, dust and the like which are present between them to be buried therein.

The image receiving layer 16 is provided for receiving an imagewise heated toner layer 22. Generally, it contains a polymer material as a main component. It is required that the polymer used for the image receiving layer 16 has an appropriate affinity with the toner layer 22, and an appropriate wetting. The image receiving layer 16 may also serve as the cushion layer 28, although not illustrated.

Figure 2A:
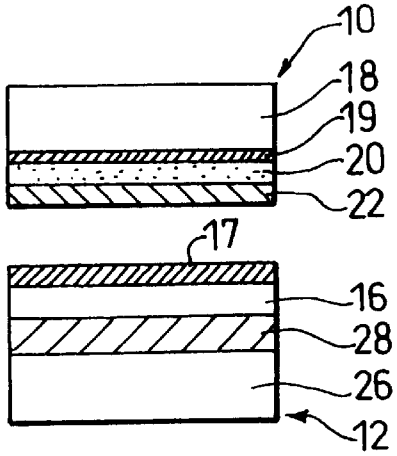
FIG. 2 is a set of sectional views showing a sequence of an image forming process applied to the image forming apparatus of the invention.

In a state shown in FIG. 2A before the toner sheet 10 and the image receiving sheet 12 are laminated, a protecting sheet 17 is layered on the image receiving layer 16 of the image receiving sheet 12 in a case that it is required. In such a case, it is preferable that the protecting sheet 17 is removed and cast away.

The image receiving layer 16 of the image receiving sheet 12 is adhesive. Because of this nature of the image receiving layer 16, the heated portion of the toner layer 22 of the toner sheet 10 is easily separated from the toner sheet 10 and transferred to the image receiving layer 16 when it comes in contact with the image receiving layer 16. The image receiving layer 16 is separable. As will subsequently be described, a final image supporting sheet (referred to as a "paper sheet") 14 and the image receiving sheet 12 are tightly laminated together, and heated and pressed together, and then those are separated one from the other, and as a result, the image receiving layer 16 is peeled off from the cushion layer 28 and transferred onto the paper sheet 14.

A process for forming a color image by a heat mode recording method using a laser head, which is an embodiment of the present invention, will be described along with a sequence of image recording steps shown in FIGS. 2A through 2F.

Figure 2B:
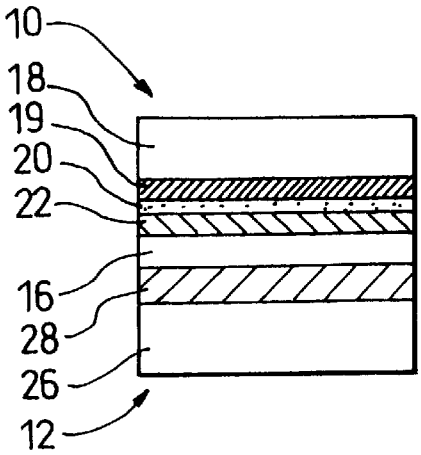

One color is first selected from among the colors, Y (yellow), M (magenta), C(cyan) and K (black). The toner sheet 10 is transported to above the image receiving sheet 12 of the selected color so as to confront the toner layer 22 of the toner sheet 10 with the image receiving layer 16 of the image receiving sheet 12 (FIG. 2A). The protecting sheet 17 of the image receiving sheet 12 is peeled off from image receiving sheet 12, and the toner layer 22 and the image receiving sheet 12 are laminated together (FIG. 2B). In this case, to secure a quality image, it is necessary to bond the toner layer 22 to the image receiving layer 16 by a uniform adhesive force by pressing those sheets together and heating them by laminating means, such as heating rollers.

Figure 2C:
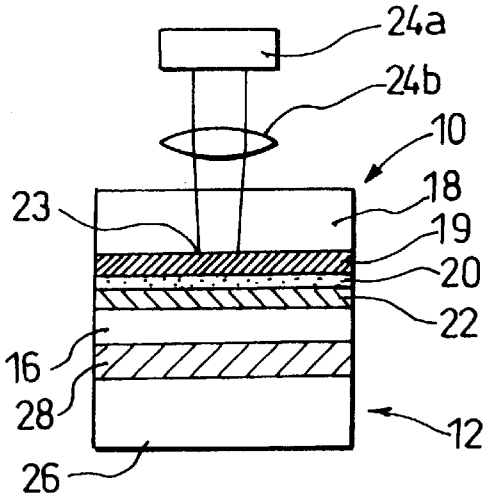

As shown in FIG. 2C, the toner sheet 10 is imagewise exposed to a laser light, which is emitted from a laser source 24*a* of a laser head 24 and reduced in diameter by an image forming lens 24*b* is radiated on the transparent support member 18 of the toner sheet 10. In this case, the laser beam is radiated on the transparent support member 18 of the toner sheet 10. Then, the laser light is transformed into heat by the photo conductive conversion layer 19 of the toner sheet 10. The transformed heat conducts to the heat stripping-off layer 20, and an image is recorded in the form of a latent image. In an alternative, the image may be recorded by imagewise heating the toner sheet 10 by use of heating/recording means, such as a thermal head. Through the image recording operation, an adhesion force acting on between the toner layer 22 and the heated portion of the heat stripping-off layer 20 is reduced. As a result, the toner layer 22 is put in a state that it is easily peeled off from the heat stripping-off layer 20. Reference numeral 23 in FIG. 2C indicates a portion where the adhesion force is reduced in the heat stripping-off layer 20.

For the lamination of the 10 and the image receiving sheet 12 by use of the laminating means, viz., the adhesion joining of the toner layer 22 and the image receiving layer 16, the lamination or the adhesion joining may be applied to only the irradiation portions by laser light or the heated portions of the laser head 24, viz., the image recording portion, and if necessary, it may be applied to the overall surfaces of both the sheets.

Figure 2D:
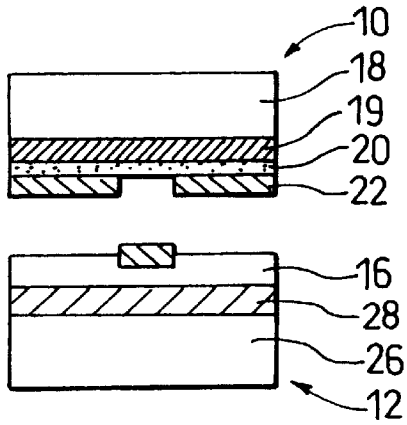

Subsequently, as shown in FIG. 2D, the toner sheet 10 is separated from the image receiving sheet 12, and the image is developed. As already stated, the heated portion of the toner layer 22 of the toner sheet 10 decreases in its bonding force to the photo conductive conversion layer 19, while its adhesion force to the image receiving layer 16 increases. Because of this, it is now placed in a state that it is easily peeled off from the toner sheet 10.

The image receiving layer 16 is adhesive. Therefore, when the toner sheet 10 is separated the image receiving sheet 12 while pressing them, by use of pressing means such as peeling-off rollers, the non heated portion of the toner layer 22 is peeled off from the image receiving layer 16 without creating any irregular peeling-off. At the same time, the heated portion of the toner layer 22 is peeled off and transferred to the image receiving layer 16, and the transferred toner layer is developed to form an image in the image receiving layer 16.

After the image formation of the selected one color is completed, the sequence of steps shown in FIGS. 2A to 2D are repeated by use of a toner sheet of another color as in the above process, to form another color image in the image receiving sheet 12 by the step of peeling-off/development.

Figure 2E:
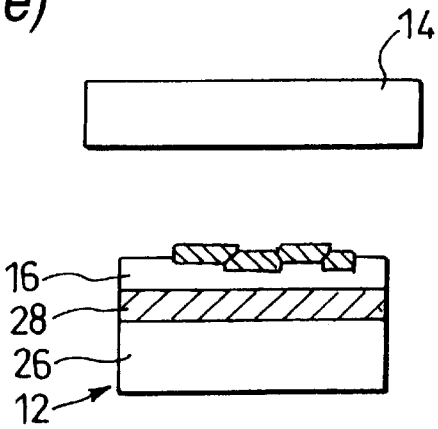
Figure 2E:
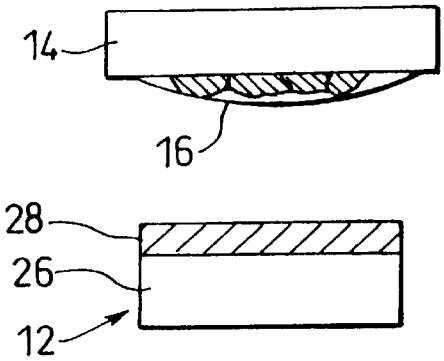

In this way, the images of all the four colors of Y, M, C and K (or three colors of H, M and C) are transferred to the image receiving sheet 12 (image receiving layer 16) by the step of peeling-off/development, whereby a color image is formed. After the image forming processes of all the colors are completed, the paper sheet 14 and the image receiving sheet 12 (image receiving layer 16) are laminated, and heated and pressed together as shown in FIG. 2E, and then the paper sheet 14 is peeled off from the image receiving sheet 12 as shown in FIG. 2F.

As already stated, the image receiving layer 16 of the image receiving sheet 12 is separable, and its surface before it is hardened is adhesive before it is hardened. Therefore, in a case where the image receiving layer 16 has such a property as to be hardened when it receives ultraviolet rays, the following procedure may be taken for the image transferring. That is, after the paper sheet 14 and the image receiving layer 16 are joined together, ultraviolet rays are radiated on the image receiving layer 16 to harden the layer 16, and then it is stripped off. By so doing, the image receiving layer 16 is peeled off from the cushion layer 28 and bonded to the paper sheet 14, thereby effecting the transfer of the color image onto the paper sheet 14.

An image forming apparatus 30 which is an embodiment of the present invention will be described with reference to FIG. 1.

The image forming apparatus 30 is generally made of up a first drum (referred to as an "image receiving drum") 32, a second drum (referred to as a "sheet drum") 34, and an exposure head 36. The image receiving drum 32 holds on the surface thereof an image receiving sheet 12 which contains an image receiving layer 16 capable of receiving a toner layer 22 of a toner sheet 10. The sheet drum 34 holds at a location being confronted with the image receiving sheet 12 a paper sheet 14 to which an image formed on the image receiving sheet 12 is to be transferred. The exposure head 36 is used for carrying out an imagewise exposing process of the toner sheet 10 laminated on the image receiving sheet 12 held on the image receiving drum 32.

To be more specific, the image forming apparatus 30 is provided with a photosensitive member supplying section 31 for supplying image the toner sheet 10 and the image receiving sheet 12 to the image receiving drum 32. The photosensitive member supplying section 31 includes a photosensitive member station 53, a pair of take-out rollers 54, and a cutter 55. The photosensitive member station 53 contains a rolled image receiving member 12 and rolled photosensitive members (referred to as "photosensitive members"), such as a plurality of coloring material sheets, e.g., normal toner sheets of four colors C, M, Y and K (or three colors C, M and Y) and special color sheets used in the printing field. The cutter 55 cuts a member taken out of the photosensitive member station 53 a predetermined length.

The image receiving sheet 12 is supplied to the image receiving drum 32, and its leading end of the image receiving sheet 12 is clamped to a sheet clamping/clamping-removal mechanism 32*a* by a clamp or the like, and wound around the drum with a turn of the image receiving drum 32. At this time, the trailing end of the image receiving sheet 12 is also clamped to the sheet clamping/clamping-removal mechanism 32*a*. At least one of the leading end clamping portion and the trailing end clamping portion is movable in accordance with a sheet length.

Then, a toner sheet 10 is laminated on the image receiving sheet 12 held on the image receiving drum 32 in exactly the same process and wound on the drum. The toner sheet 10 is laminated on the image receiving sheet 12 by the utilization of a pressure applied by a roller 58 of a laminating mechanism 38. An image receiving layer 16 as the uppermost layer of the image receiving sheet 12 is adhesive. The image receiving sheet 12 is wound while being pressed at a predetermined pressure by the roller 58. Therefore, the image receiving layer 16 of the image receiving sheet 12 may be bonded to the toner layer 22 of the toner sheet 10 at a uniform adhesive force without wrinkles.

In order to secure a uniform and strong lamination of the toner sheet 10 to the image receiving sheet 12, it is preferable that the heating of those sheets is performed during the pressurizing by the roller 58. For the heating condition, 130° C., preferably 100° C. or lower, is preferable in the light of thermal mechanical properties, for example, thermal expansion coefficient of the members, and when taking into consideration restrictions of its influence on the exposure laser spot. Such a pressurizing may be achieved by any other suitable means than the roller 58, for example, a bar-like pressing member with a sharpened tip.

The sheets mentioned above are preferable because wrinkles and the like may be taken out of the sheets by stretching the sheets when those are wound on the drums. The image receiving drum 32 may be provided with sheet absorbing means, if necessary. Additionally, a circumferential length of the image receiving drum 32 is selected to be longer than an image recording length.

With the process thus far described, the steps of FIGS. 2A and 2B are executed.

The exposure head 36, which will next be described, includes a modulating means, and further a laser head 24 (see FIG. 2C) and a sub-scanning means 61. The laser head 24 includes a laser source 24*a* for emitting high density energy light, such as a laser beam, an image forming lens 24*b* for adjusting a beam spot diameter of the laser light, and the like. The sub-scanning means 61 moves the laser head 24 in the axial direction (vertical to a paper surface of the drawing) of the image receiving drum 32, thereby performing a sub-scanning operation. A main scan for the toner sheet 10 by laser light is carried out by the utilization of a rotation of the image receiving drum 32.

In an alternative, a moving means is installed on the image receiving drum 32, and the sub-scanning means is not installed on the exposure head 36. The sub-scanning operation is performed in a manner that the image receiving drum 32 is moved in the axial direction while rotating the drum in the main-scan direction.

The modulation of the laser light by the image signal is carried out in a known manner. In the case of the semiconductor laser, for example, a current injected into the laser is controlled by a signal. The above-mentioned image signal is transferred from an image reader located outside the image forming apparatus 30 of the embodiment, an image processor and various storing media to the control unit 54. After subjected to a necessary process, it is transferred to the exposure head 36. In the exposure head 36, a control of a heat mode exposure by use of the laser head 24 is performed.

The control unit 54 controls the respective portions of the image forming apparatus 30 of the embodiment, such as the sub-scan by the sub-scanning means 61 of the exposure head 36, the main scan based on the rotation of the image receiving drum 32, and a rotation of the sheet drum 34, and an overall control sequence of the image forming apparatus.

A signal which is controlled in accordance with an image signal by the control unit 54 is sent to the exposure head 36. A modulation of the laser light is modulated in accordance with this. At this time, the photo conductive conversion layer of an image portion of the toner sheet 10 is placed to an easy toner peeling-off state. This indicates that an image has been recorded, and also indicates that the image transfer onto the image receiving sheet 12 is completed (see FIG. 2C).

Subsequently, the sheet clamping/clamping-removal mechanism 32*a* is removed. The toner sheet 10 is stripped off from the image receiving sheet 12 on the image receiving drum 32. An image on the toner sheet 10, which is recorded as a latent image thereon, is transferred onto the image receiving sheet 12 and developed, whereby an image is formed on the image receiving sheet 12 (see FIG. 2D).

In a peeling-off mechanism 42, a peeling-off roller 62 is turned about a fulcrum 67*a* supported, by shaft, on an arm 67 to be brought into contact with and separated from the roller 36. Pressing means 68 is provided which presses the peeling-off roller 62 the lamination consisting of the image receiving sheet 12 and the toner sheet 10 on the image receiving drum 32 with the aid of the arm 67.

An adhesive force of the toner layer 22 imagewise reduces by the heat mode exposure, and the arm 67 is turned about the fulcrum 67*a* toward the lamination the toner sheet 10 bearing an image as a latent image and the image receiving sheet 12. A comb-gear guide plate 65, which turns in unison with those members, is inserted to between the image receiving sheet 12 and the toner sheet 10, and the lamination is pressed by pressing the toner sheet 10 of the lamination by the peeling-off roller 62 which rotates in unison with those members. It is possible to easily insert the comb-gear guide plate 65 to between the toner sheet 10 and the image receiving sheet 12 if one of those sheets is longer or shorter in bonding length than the other. Thereafter, the image receiving drum 32 is rotated, and the peeling-off roller 62 and division rollers 63 and 64, which rotate together with the peeling-off roller 62, are rotated. With the rotations, the toner sheet 10 is moved along the comb-gear guide plate 65 and caused to be nipped between the peeling-off roller 62 and the division roller 63. In this way, the toner sheet 10, while being pressed by the peeling-off roller 62, is transported in a state that it is nipped between the peeling-off roller 62 and the division roller 63, and peeled off from the image receiving sheet 12.

The peeled off toner sheet 10 travels along a transport path, and reaches a selector section 50. In the selector section, the sheet, if it is the toner sheet 10, is selectively discharged to a casting tray 52*b*, located outside the image forming apparatus 30. The steps of FIGS. 1B to D are sequentially repeated for three to four colors, whereby a color image is formed on the image receiving sheet 12 (see FIG. 2E). During this execution of the steps, the toner sheet 10 is sequentially changed to one other sheet.

The sheet drum 34 is disposed under the image receiving drum 32 in the embodiment, and has a function to hold paper sheets 14 to which toner images formed on the image receiving sheet 12 are to be transferred. The paper sheet 14 is supplied from a paper supplying device 44, and the paper supplying device 44 is provided with a manual insertion portion 44*a* and a paper supplying tray 73. The paper supplying device 44 is designed to have a generation construction. It supplies the paper sheets 14 at given timings to the sheet drum 34 with the aid of a paper supplying roller 72 and the like. The toner sheet 10 laminated on the image receiving sheet 12 is sequentially changed to another toner sheet of each color. Because of this, design is made so that the image receiving drum 32 is movable (brought into contact with and separated from) relative to the sheet drum 34 so as not interrupt the sheet changing operation. The sheet drum 34 may be disposed at a location vertical to the image receiving drum 32 other than the location under the same or on the side of the image receiving drum 32.

After the image transferring from the toner sheet 10 to the image receiving sheet 12 on the image receiving drum 32 is completed, the sheet drum 34 moves relative to the image receiving drum 32 to come in contact with the latter while timing the positioning of the image receiving sheet 12 to the paper sheet 14. For the drum moving mechanism, it is considered that a mechanism in which only the sheet drum 34 is moved is the simplest in construction.

The sheet drum 34 is a heating drum containing heating means therein. It brings an image formed on the image receiving sheet 12 on the image receiving drum 32 into contact with the image receiving sheet 12 on the sheet drum 34, and fuses and fixes the image while carrying out the image transferring.

A new paper sheet 14 to which an image is to be transferred is set on the sheet drum 34 or a paper sheet 14 to which an image has been transferred is removed from the same. To make those operations easy, the sheet drum 34, like the image receiving drum 32, may be provided with a sheet clamping/clamping-removal mechanism 34*a*. The sheet drum 34 may be designed such that air suction holes are formed in the outer peripheral of the sheet drum 34, and the paper sheet 14 is attracted by an absorbing means.

If so designed, the paper sheet 14 may be wound on the outer periphery of the sheet drum 34 without wrinkling the paper sheet. Use of the combination of the absorbing means and the sheet clamping/clamping-removal mechanism 34*a* is preferable. Either of them may be used as a matter of course.

The paper sheet 14 may be attached to the sheet drum 34 before the image forming process commences or at the end of forming an image on the image receiving sheet 12. When the paper sheet 14 is attached to the sheet drum 34 before the image forming process commences, a subsequent process will be carried out in a through-process manner.

The paper sheet 14, which has undergone the image transferring thereto and the fixing of the transferred image on the sheet drum 34, s peeled off from the sheet drum 34 by a peeling-off mechanism 42*a* constructed as of the image receiving drum 32. And the paper sheet travels on the transport pat and reaches the selector section 50. In the selector section 50, the paper sheet 14 is selectively sent to a take-out tray 52*a* of a tray section 52, which is located outside the image forming apparatus 30.

The image receiving sheet 12 on the image receiving drum 32, which has undergone the image transferring thereto, also travels on the transport path, and in the selector section 50, it is selectively discharged toward the casting tray 52*b* of the tray section 52, located outside the image forming apparatus 30.

Through the process, a full color image is formed as a hard copy on the paper sheet 14.

According to the above-mentioned embodiment, an image formed on the image receiving sheet 12 on the image receiving drum 32 may directly be transferred onto a paper sheet 14 on the sheet drum 34. Therefore, the overall process may be automated and continuously be carried out. Further, the image forming apparatus may be realized which prevents the dust attachment during the image forming process.

A color image forming apparatus according to another embodiment of the present invention will be described.

Figure 3:
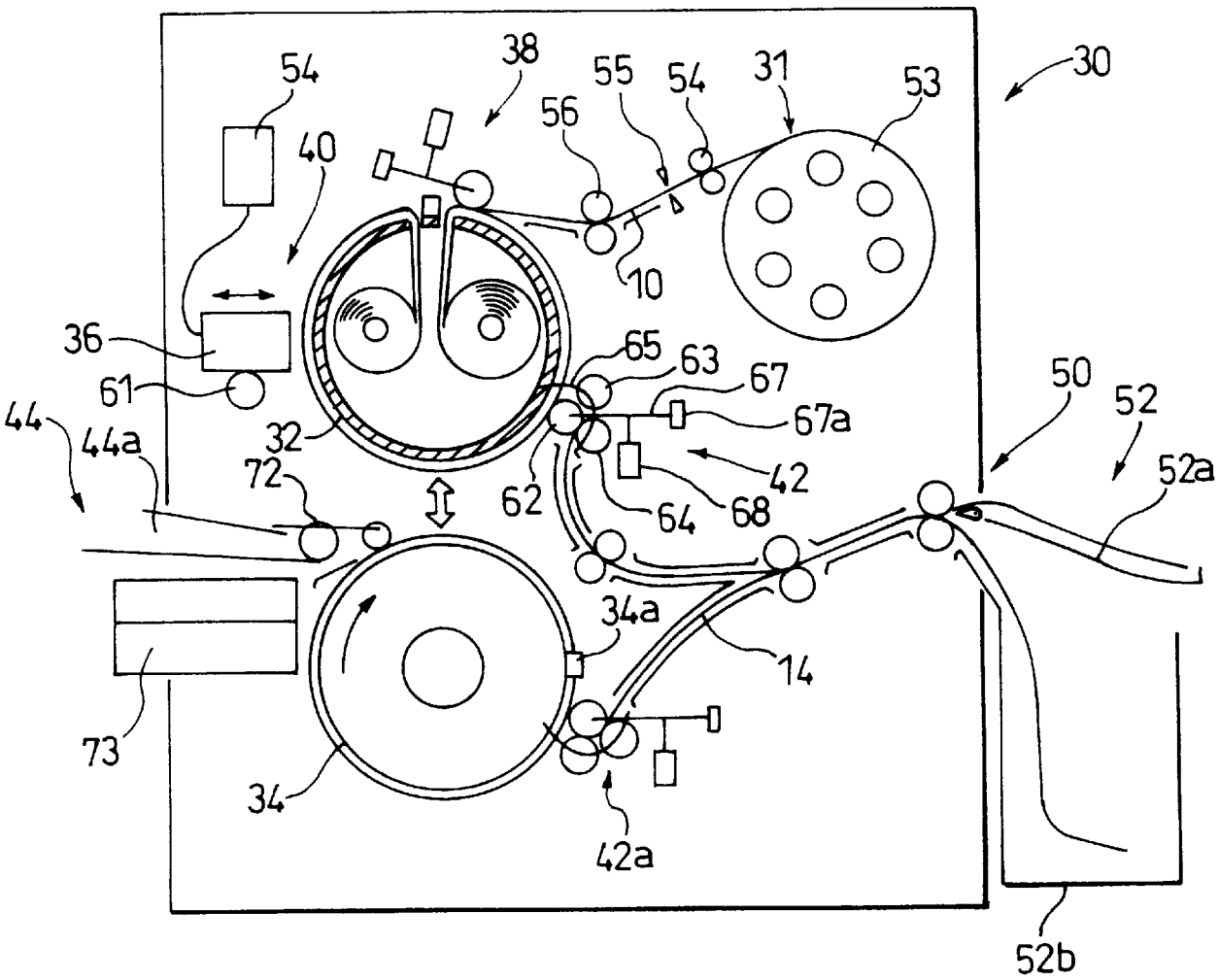
FIG. 3 is a side view schematically showing a relationship between an image receiving drum and a sheet drum in a color image forming apparatus according to another embodiment of the present invention.

FIG. 3 is a side view schematically showing a color image forming apparatus according to another embodiment of the present invention. In FIG. 3, like reference numerals are used to designate like or equivalent portions in the FIG. 1 embodiment, and hence description of those portions will be omitted.

A difference of the image forming apparatus of the present embodiment from that shown in FIG. 1 resides in that it includes an image receiving drum 90 with a function of supplying an image receiving sheet and taking up the same. The supplying of the toner sheet 10 in this embodiment is similar to that in the FIG. 1 embodiment. The exposure, the image transferring to the paper sheet 14, the peeling off and the discharging to the devices located outside the image forming apparatus are also similar to those in the FIG. 1 embodiment.

The image receiving drum 90 is arranged such that it is capable of successively supplying and taking up an image receiving sheet 92, and the supplying and removing functions of the image receiving sheet 92 are mechanized. An image forming method for forming an image on the toner sheet 10 onto the image receiving sheet 92 is similar to that shown in the FIG. 1 embodiment.

Figure 4:
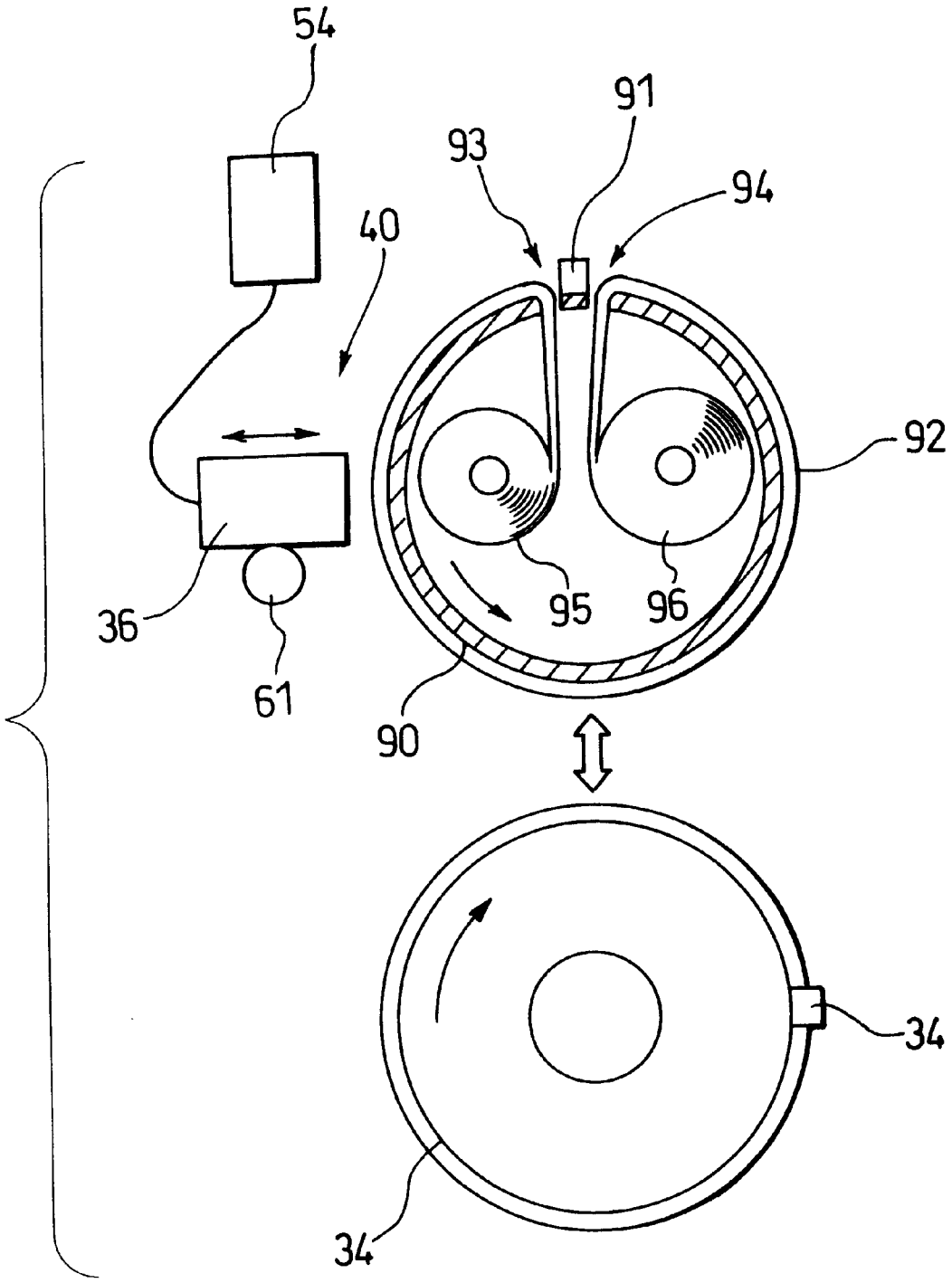
FIG. 4 is a partially cross sectional view showing a relationship between the image receiving drum and the sheet drum 34 in the image forming apparatus of FIG. 3.
Figure 5:
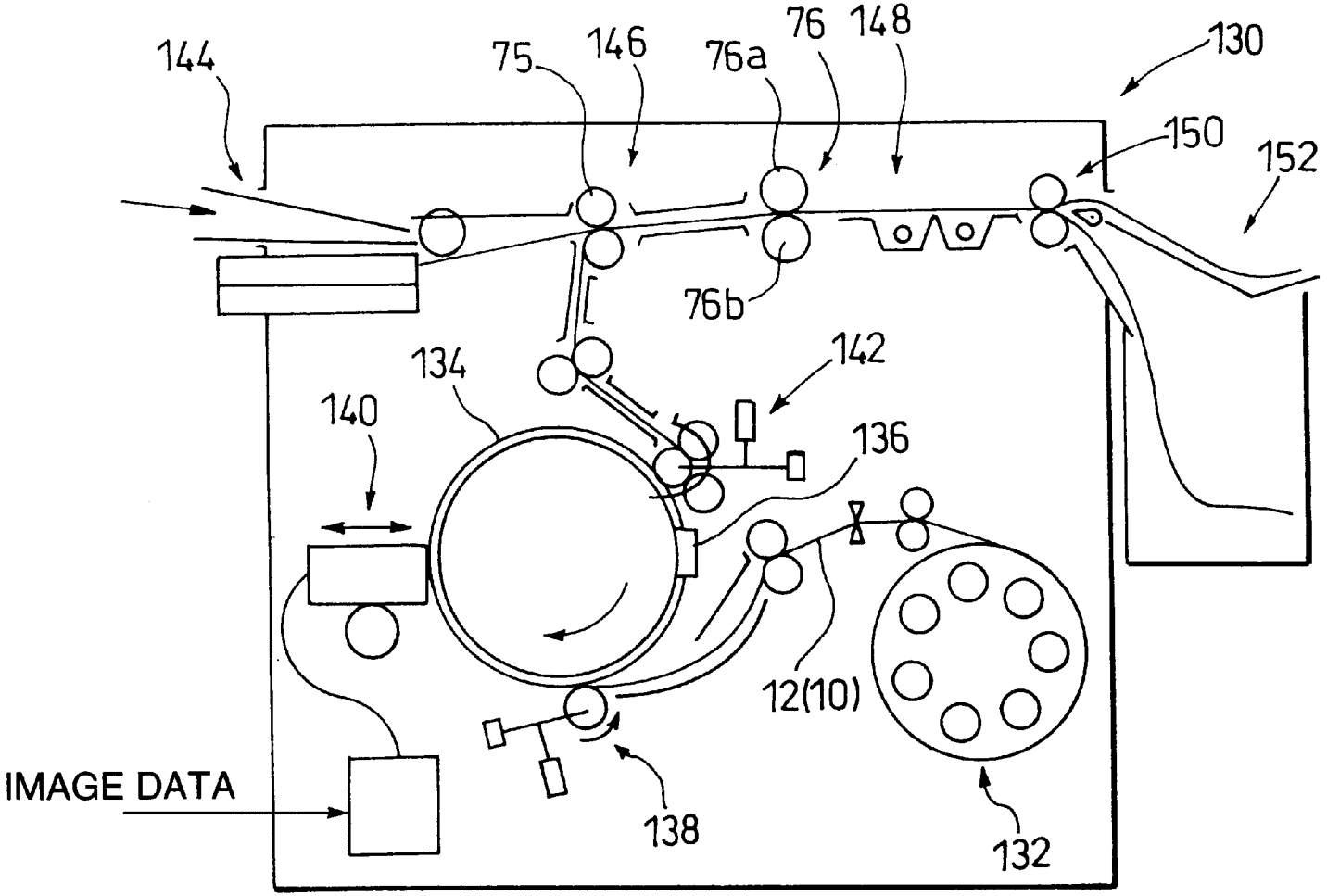
FIG. 5 is a side view showing a conventional image forming apparatus.

FIG. 4 is a partially cross sectional view showing a relationship between the image receiving drum and the sheet drum 34 in the image forming apparatus of FIG. 3. A construction of the image receiving drum 90 follows. An image-receiving-sheet supplying port 93 and an image-receiving-sheet take-up port 94 as axial slits of the image receiving drum 90, are disposed while being confronted with each other. A sheet clamping/removal mechanism 91 used for the toner sheet 10 is disposed between the image-receiving-sheet supplying port 93 and the image-receiving-sheet take-up port 94. An image-receiving-sheet supplying roll 95 and an image-receiving-sheet take-up roll 96 are disposed within the image receiving drum 90.

In the image forming apparatus of this embodiment, the supplying roll 95 for supplying the image receiving sheet 92 and the take-up roll 96 for taking up the same, which are placed within the image receiving drum 90, are first driven, and a new portion of the image receiving sheet 92 is fed out through the image-receiving-sheet supplying port 93 onto the surface of the image receiving drum 90, and are set thereon. A toner sheet 10 of the first color (for example, black (K)) is clamped onto the image receiving sheet 92 on the image receiving drum 90 by the sheet clamping/removal mechanism 91, and set (pressed and bonded) on the surface of the image receiving sheet 92 by the laminating mechanism 38.

As described above, the image receiving sheet 92 is adhesive. Therefore, when the toner sheet 10 is wound and pressed while pressing it at a given pressing force by the laminating mechanism 38, the toner sheet 10 is not wrinkled as matter of course. Additionally, the heel piece 11 of the toner sheet 10 is bonded to the image receiving layer of the image receiving sheet 92 on the image receiving drum 90 at a uniform adhesion force.

Subsequently, the paper sheet 14 is set onto the sheet drum 34 and image forming processes are carried out in similar manners to those in the first embodiment.

After the image forming processes have been completed, the image receiving drum 90 and the sheet drum 34 are positioned at their leading ends in a similar manner to that shown in FIG. 3 in the first embodiment, and are brought into contact with each other. An image formed on the a12*a* on the image receiving drum 90 is brought into contact with the paper sheet 14 on the sheet drum 34, and the transferring of the image is performed while synchronously rotating both the drums (see FIG. 2F).

According to the present embodiment, an image formed on the image receiving sheet 92 on the image receiving drum 90 may directly be transferred onto a paper sheet 14 on the sheet drum 34. Therefore, the overall process may be automated and continuously be carried out. Further, the image forming apparatus may be realized which prevents the dust attachment during the image forming process. Furthermore, an image forming apparatus which is considerably easy in its handling is realized since the setting of the image receiving sheet 92 is automated.

While some specific embodiments of the present invention have been described, it should be understood that the invention is not limited to those embodiments, but it may variously be changed, modified, and altered without the true spirits of the invention. In the above-mentioned embodiments, the laser exposure head is used for the thermal energy applying means. An apparatus for recording an image by heating by the use of a thermal head may also be realized within the scope of the invention.

As seen from the foregoing description, in the present invention, a drum for the paper sheet is provided, and it is brought into contact with the drum holding an image receiving sheet thereon, whereby the image transferring is carried out again. Therefore, the invention succeeds in providing an image forming apparatus having the following advantages. Occurrence of paper jam is suppressed. An overall image forming process is automated while securing a stable transporting capability, and carried out in a through-process manner. The dust sticking is prevented. Further, the re-transferring of the image onto the paper sheet is well performed.

What is claimed is:

1. An image forming apparatus comprising:

a first drum having an image receiving portion on which a toner sheet with an image forming thin film is superimposed in a state that said image forming thin film of said toner sheet is layered on said image receiving portion of said first drum;

an exposure section for applying imagewise thermal energy toward said first drum through said toner sheet side; and a second drum for holding a final image supporting sheet thereon for finally supporting an image thereon;

wherein after an image is formed through said likewise application of the thermal energy by said exposure section, said toner sheet is separated from said image receiving portion of said first drum, an image is transferred onto said image receiving portion, and said final image supporting sheet is pressed against a predetermined location on said image receiving portion by a relative movement of said first drum to and from said second drum.

2. An image forming apparatus according to claim 1, wherein said image receiving portion includes an image receiving sheet and an image receiving layer layered on said image receiving sheet.

3. An image forming apparatus according to claim 1, wherein the first and second drums are relatively movable each other so that after the image is transferred to the image receiving portion, the final image supporting sheet is pressed against a predetermined location on the image receiving portion by use of the second drum in a state that the image receiving portion is not peeled off the first drum.

4. An image forming apparatus according to claim 2, wherein said image receiving sheet is supplied from a sheet supplying portion located within said fist drum, through an axially oriented opening formed in the surface of said first drum, to the surface of said first drum, and is taken up by a take-up portion located within said first drum.

5. An image forming apparatus according to claim 1, wherein the toner sheet comprises:

a support member;

a photo thermal conversion layer including a photo thermal conversion material formed on the support member;

a heat peeling-off layer formed on the photo thermal conversion layer; and a toner layer formed on the heat peeling-off layer, wherein the thermal energy is generated by converting the photo energy in the photo thermal conversion layer.

6. An image forming apparatus according to claim 5, wherein a source of the photo energy is a laser.

7. An image forming apparatus according to claim 5, wherein a source of the photo energy is a xenon flash lamp.

8. An image forming apparatus according to claim 1, wherein the thermal energy is generated by a thermal head.

* * * * *